US005472036A

United States Patent [19]

Judkins

[11] Patent Number: 5,472,036

[45] Date of Patent: Dec. 5, 1995

[54] CORD LOCK AND RELEASE SYSTEM FOR BLINDS

[76] Inventor: Ren Judkins, 46 Newgate Rd., Pittsburgh, Pa. 15202

[21] Appl. No.: 177,154

[22] Filed: Jan. 3, 1994

Related U.S. Application Data

[63] Continuation-in-part of Ser. No. 853,490, Mar. 18, 1992, Pat. No. 5,275,222.

[51] Int. Cl.[6] ..... E06B 9/324

[52] U.S. Cl. ..... 160/178.2; 24/134 R

[58] Field of Search ..... 160/178.2, 168.1, 160/173, 178.1, 173; 24/134 R, 134 KB, 115 H, 129 R

[56] References Cited

U.S. PATENT DOCUMENTS

| | | |
|---|---|---|
| 950,952 | 3/1910 | Perrott . |
| 1,086,232 | 8/1912 | Hedberg . |
| 2,087,865 | 7/1937 | Walker . |
| 3,191,664 | 6/1965 | Hurkmans . |
| 3,221,802 | 12/1965 | Hurkmans . |
| 3,294,153 | 12/1966 | Fountain . |
| 3,455,365 | 7/1969 | Stall . |
| 3,633,646 | 1/1972 | Zilver . |
| 3,727,665 | 4/1973 | Debs . |
| 3,799,236 | 3/1974 | Debs . |
| 3,931,846 | 1/1976 | Zilver . |
| 4,245,688 | 1/1981 | Vecchiarelli . |
| 4,347,885 | 9/1982 | von Knorring et al. . |
| 4,413,664 | 11/1983 | Istha . |
| 4,443,915 | 4/1984 | Niemeyer . |
| 4,646,808 | 3/1987 | Anderson . |
| 4,660,612 | 4/1987 | Anderson . |

*Primary Examiner*—David M. Purol

*Attorney, Agent, or Firm*—Buchanan Ingersoll; Robert J. Pugh

[57] ABSTRACT

A cord lock and release system for use in a window blind assembly. The system has a stationary member, a locking member and a movable segment. The locking member is positioned so that at least one lift cord can move across a portion of the locking member when the locking member is in an open position. The lift cords will be restrained by frictional contact with the movable and stationary members when the locking member is in a locked position. The locking member is biased towards a locked position. A release linkage is attached to the movable member so that when a force is applied to the linkage the movable member moves the locking member toward the open position.

52 Claims, 9 Drawing Sheets

FIG. 10
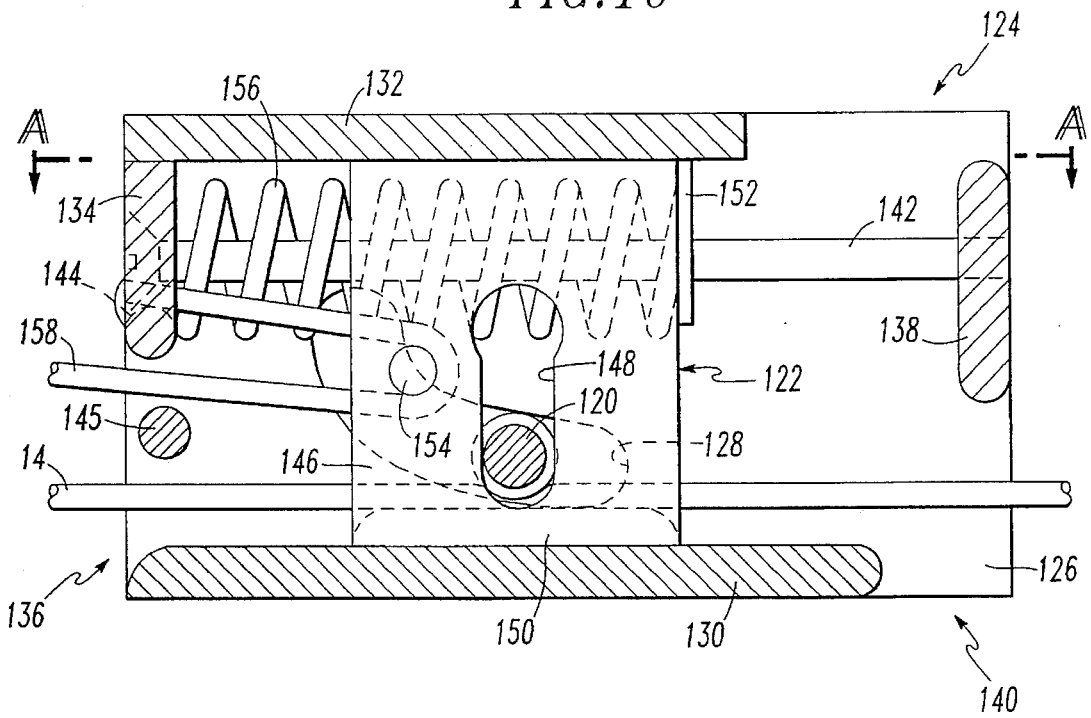
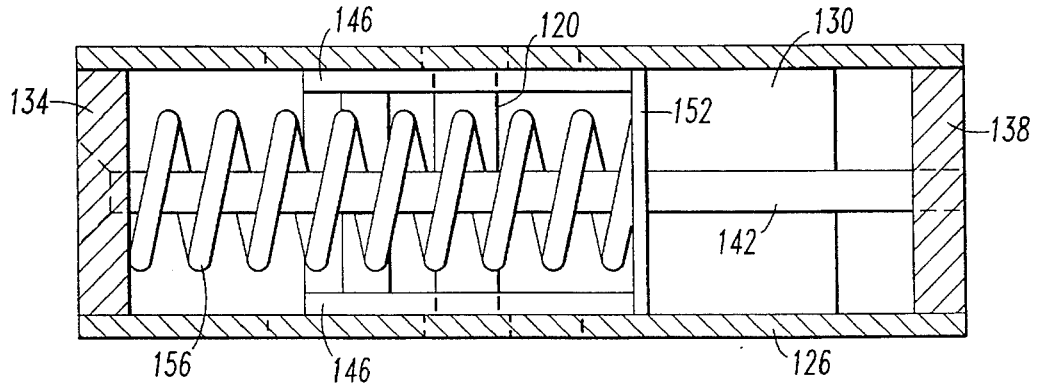
FIG. 11

FIG. 12
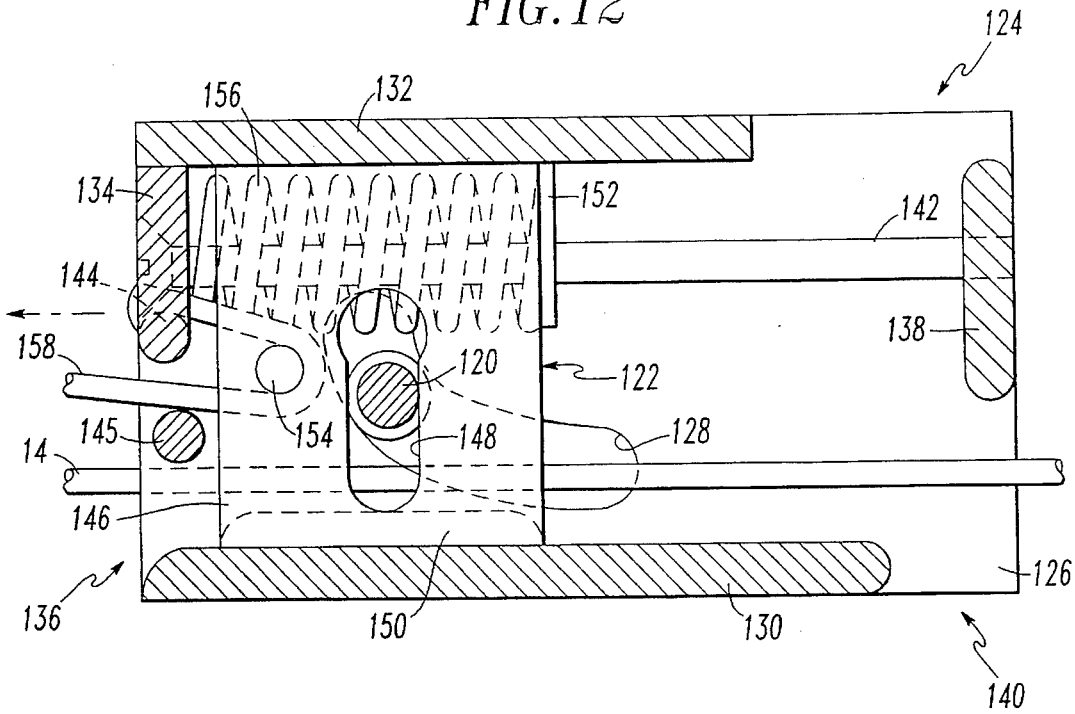
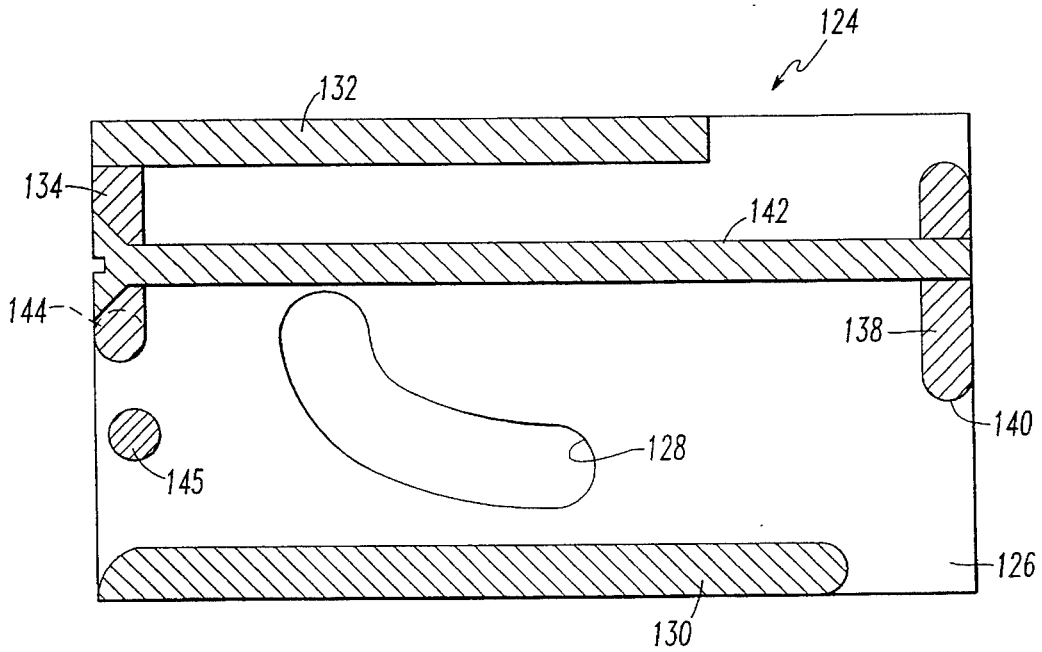
FIG. 13

FIG. 14
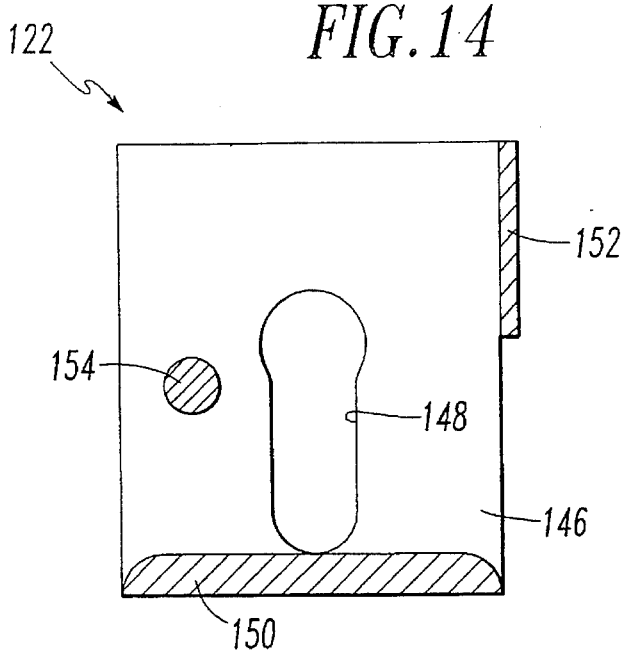
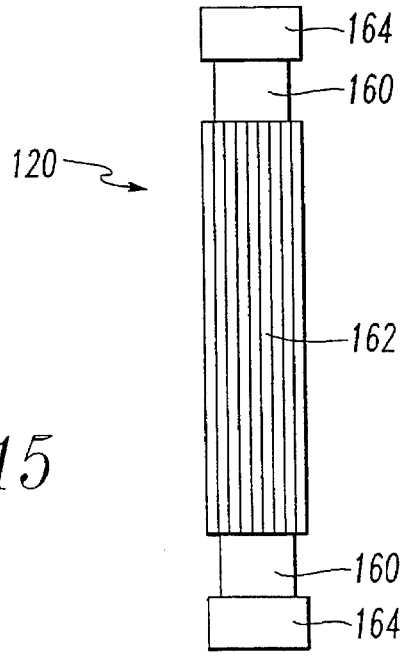
FIG. 15

FIG. 16
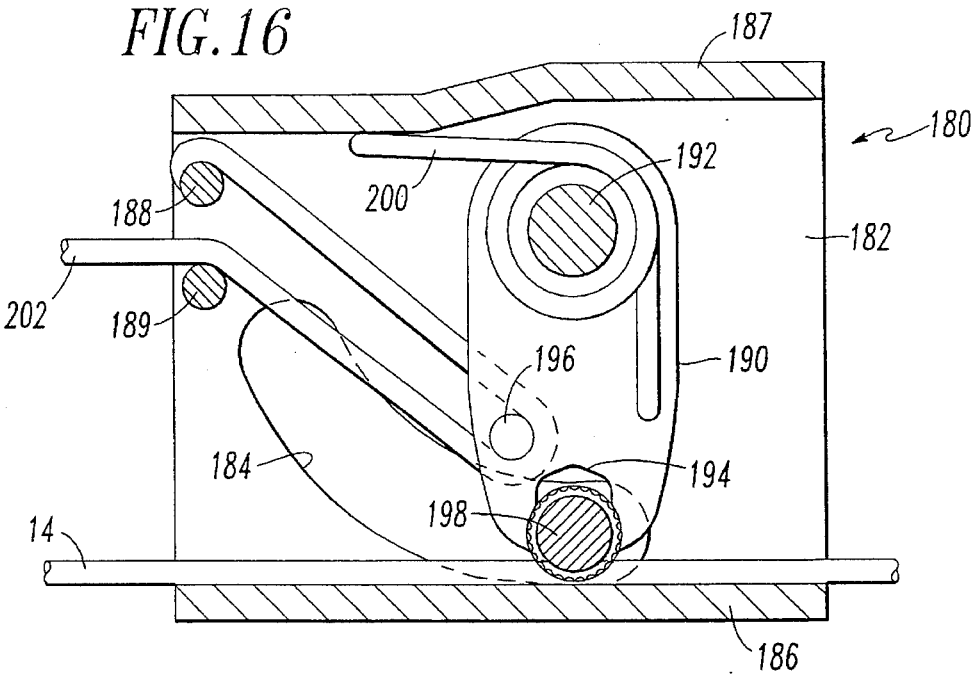
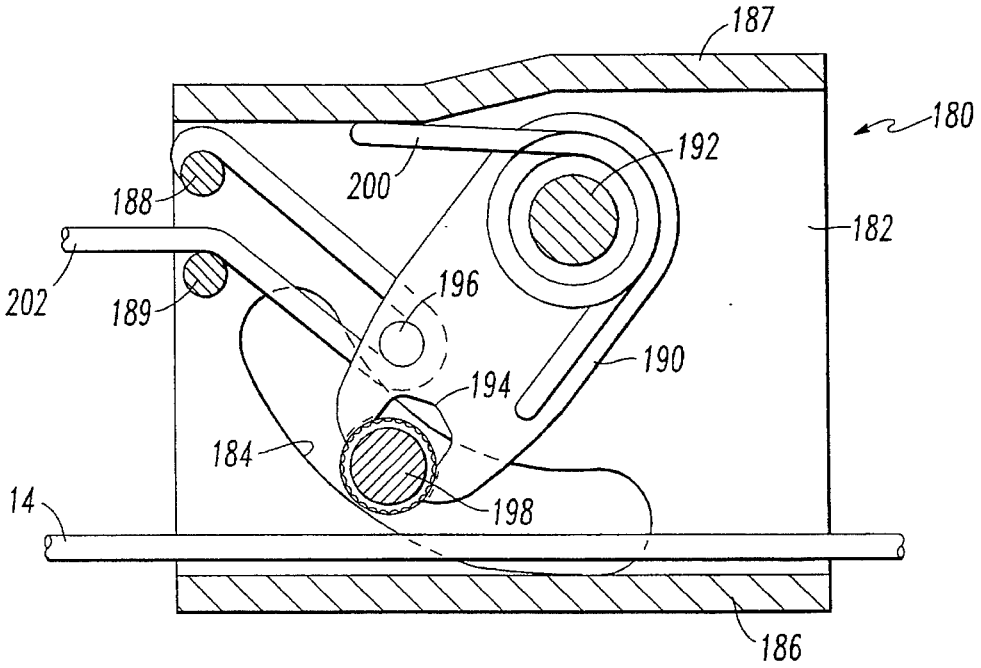
FIG. 17

CORD LOCK AND RELEASE SYSTEM FOR BLINDS

RELATED APPLICATION

This application is a continuation-in-part of application Ser. No. 07/853,490, filed Mar. 18, 1992, now U.S. Pat. No. 5,275,222.

BACKGROUND OF THE INVENTION

1. Field of the Invention

This invention relates generally to a cord lock and release system for a window blind assembly. More particularly, the invention relates to a cord lock and cord release system capable of being actuated independent of the positioning of the cords.

2. Description of the Prior Art

Window blind assemblies are typically operated by having one or more lift cords being connected at one end to the window blinds and having the other end which extends out of the blinds being accessible to the operator. The window blinds are typically raised by the operator pulling on the accessible portion of the lift cords and are lowered by allowing the weight of the shade to pull the lift cords back into the blind. When the operator has moved the blind to a desired position, the lift cords must be held in place so that the blind will remain in the chosen position after the operator has let go of the lift cords. For this reason, the art has developed various types of cord locking devices. Some cord locks such as those disclosed in U.S. Pat. No. 4,443,915 to Niemeyer employ a cam-like tumbler and others such as those shown in U.S. Pat. No. 4,660,612 to Anderson have a jaw-like cord lock structure. To operate these types of cord locks, some secondary movement of the lift cords other than in and out of the blind is required. For example, to lock and to unlock the device of Niemeyer, the operator must move the lift cords transversely either upwards or downwards across an inclining surface. In order to operate the device of Anderson, the operator must move the lift cords away from the plane of the blind assembly. Often, because of the location of the blind assembly in a room or because of furnishings in the room, movement of the lift cords in the manner required in the prior art is very difficult. It is also confusing to the operator because different products might require different secondary movements of the lift cords as in the above examples and it is not obvious to the operator which motion is correct.

SUMMARY OF THE INVENTION

We provide a cord lock and release system for use in a blind assembly that utilizes one or more lift cords to effectuate the raising or lowering of the blinds. The cord lock and release system automatically locks or prevents one or more lift cords from returning into the blind. The operator can release the lift cords via a direct mechanical linkage. The cord lock and release system employs a cord valve through which the lift cords are disposed. The cord valve has a spring or other means of bias to always allow the lift cords to pass out of the blind, but prevent them from returning. The cord lock and release system also has a linkage that is connected to the cord valve such that pulling or moving the linkage overcomes the spring bias and allows the lift cords to travel freely in either direction through the cord valve. The speed at which the lift cords travel through the cord valve is also controlled by an adjustable drag which can be applied either at the linkage or at the cord valve.

In a first preferred embodiment of the cord lock and release system, the cord valve is a planar slide plate cooperating with a stationary housing. The slide plate has a cord opening through which the lift cords are disposed. The planar slide plate further has a spring connected to it. Immediately adjacent and parallel to the planar slide plate is a stationary housing that also has an opening. The stationary housing is fixed to the blind assembly so that it does not move relative to the blind assembly. When no release force is applied to the cord valve, the spring biases the planar slide plate to be positioned in relation to the stationary housing such that the planar slide plate opening and the stationary housing opening are offset from one another. Because of the positioning of the stationary housing in relation to the planar side plate, the lift cords are firmly held by the gripping contact of the slide plate and the stationary housing on the lift cords. The planar slide plate and the stationary housing are both preferably tapered so that the tapered-outward portions of each may more firmly grip the cords. Thus held, the cords are unable to travel into the blind and the blind is prevented from being lowered. The operator is always able, however, to raise the blinds by pulling the lift cords out of the blind. When the cords are thus gripped, the cord valve is said to be in a closed, locked position. In the locked position, the weight of the blind is held by the spring. A linkage is attached to the planar slide plate such that when the linkage is pulled an external force is applied to the planar slide plate opposing the spring bias causing the planar slide plate opening and the stationary housing opening to move toward alignment. When the planar slide plate opening and the stationary housing opening are thus aligned, the cord valve is said to be in an open position. In the open position, there is no longer any gripping contact of the plate and housing acting on the lift cords and the lift cords are permitted to move freely through the cord valve. The amount of gripping contact of the plate and housing on the lift cords can be varied by varying the amount of external force applied to the linkage. When the linkage no longer has an external force applied to it, the spring biases the cord valve back to a locked position.

In a second embodiment of the cord lock and release system, the cord valve has a pivotable cam-like tumbler cooperating with an intermediary surface and a stationary surface. The stationary surface is fixed to the blind assembly and is thus prevented from moving. The lift cords are disposed between a distal clamp portion of the tumbler and the intermediary surface. When no external forces are applied to the cord valve, the clamp portion of the tumbler is biased towards the intermediary surface and stationary surface. This biasing can be by any preferred means such as by gravity or preferably by a spring. An intermediary plate preferably made of an elastomeric material is placed between the lift cords and the stationary surface to distribute the point of impingement of the tumbler on the cords over a greater area and to reduce the relative motion between the lift cords and the stationary surface during locking and releasing of the lift cords. Thus, in this embodiment, the spring forces the tumbler into a position where the motion and friction of the lift cords on the tumbler pull the tumbler into a jammed position with the intermediary surface. The lift cords are disposed between the tumbler clamp portion and the intermediary surface and are gripped. When the cords are thus gripped, the cords are prevented from traveling into the blind which prevents the blind from being lowered. The operator can always raise the blind by causing the lift cords to travel out of the blinds as the cord valve only prevents the lift cords from traveling into the blind. A linkage is attached to the tumbler such that when the linkage is pulled, an external force is applied no the tumbler opposing the spring bias. This external force causes the clamp portion of the tumbler to be moved away from the intermediary and stationary surfaces. When the clamp portion of the tumbler is thus separated from the intermediary surface, the cord valve is said to be in an open position. In the open position, there is no longer any gripping of the tumbler and the intermediary surface on the lift cords, and the lift cords are thus permitted to move freely through the cord valve. The amount of gripping contact of the tumbler and intermediary surface on the lift cords can be varied by varying the amount of external force applied to the linkage. Once the linkage is released, the spring biases the tumbler back into contact with the lift cords. When the tumbler is in contact with the lift cords, the distal surface of the tumbler is moved closer to the stationary surface as the lift cords are pulled into the blind and through the cord valve by the weight of the blind. The distal portion will eventually reach such a proximity to the stationary surface that the lift cords will be gripped and prevented from moving further into the blind. When the lift cords are thus gripped, the cord valve is in a locked position.

In further embodiments of the invention, the cord lock and release system is similar to the previous embodiments described above except that the previous embodiments utilize a locking member cooperating with a stationary surface or structure. Instead, the subsequently-described embodiments utilize a biased movable segment that cooperates with the locking member and the stationary structure. The movable segment is movable between a first position and a second position relative to the stationary structure, in which the movable segment is biased toward the second position. The locking member is movably connected to the stationary structure so as to be movable along a preselected path relative to the stationary structure. The release linkage is then attached at one end to the movable segment with the other end of the release linkage being accessible by the operator.

When the operator actuates the release linkage, the movable segment is moved into the first position, moving the locking member into the open position. And when the operator releases the release linkage, a biasing means, such as a spring, biases the movable segment into the second position. When the movable segment is in the second position, a means for biasing the locking member into the locked position causes the locking member to lock the lift cords between the locking member and a holding surface. The means for biasing the locking member into the locked position may be contact with a biased movable segment, may be a spring, or may be gravity.

The locking member may be a locking cam or may be a locking pin. The stationary structure may be the headrail but is preferably a separate housing attached to the headrail. The stationary structure housing may be attached directly to the headrail or may be held within a bracket which is attached to the headrail. The stationary structure is characterized as providing a preselected path along which the locking member may be moved. The stationary structure may have a pair of opposed slotted sidewalls through which the locking pin is disposed. The slots in the sidewalls are preferably arcuate and provide the preselected path. Alternatively, the stationary structure may have a pivotal connection at which the locking cam is connected, such that the locking cam preselected path is arcuate.

When the locking member is a locking cam, the movable segment moves linearly in a selected direction relative to the stationary structure. The movable segment may have a pair of opposed slotted sidewalls. The slots in the sidewalls are preferably angled and are preferably arcuate. A guide pin is disposed through the cam at a distance from the pivotal connection of the cam to the stationary structure. Also, when the locking member is a cam, the movable segment may alternatively have at least one, and preferably two, raised, protruding portions which are preferably curved. The raised curve portions extend in a direction perpendicular to the direction of movement of the movable segment. The raised, curved portions of the movable segment contact the locking cam when the movable segment is moved into the first position, moving the locking cam into the open position. When the locking member is a pin, the movable segment may have a pair of opposed, notched sidewalls. The notches of the movable segment sidewalls extend generally perpendicular to the direction of movement of the movable segment.

The stationary structure may have a pair of opposed slotted sidewalls in which the ends of the pin are disposed. The movable segment may be a cam pivotably connected to the stationary structure which has a notch at some distance from the cam pivot connection. The locking pin is provided within the slot of the cam. The pin is moved in preferably an arcuate path when the cam moves. Alternately, the movable segment may follow a lineal path relative to the stationary structure.

Other objects and advantages of the invention will become apparent from a description of certain present preferred embodiments thereof shown in the drawings.

BRIEF DESCRIPTION OF THE DRAWINGS

FIG. 10 is a side cross-sectional view of a third preferred cord lock and release system in the locked position.

FIG. 11 is a top cross-sectional view taken along line A—A of FIG. 10.

FIG. 12 is a view similar to FIG. 10 of the cord lock and release system in the open position.

FIG. 13 is a side cross-sectional view of the stationary structure of the third embodiment.

FIG. 14 is a side cross-sectional view of the movable segment of the third embodiment.

FIG. 15 is a top view of the locking pin of the third embodiment.

FIG. 16 is a side cross-sectional view of a fourth preferred cord lock and release system in the locked position.

FIG. 17 is a view similar to FIG. 16 of the cord lock and release system in the open position.

DESCRIPTION OF THE PREFERRED EMBODIMENT

In a blind assembly in which the blinds or shades are connected to an end of one or more lift cords and are moved by repositioning the other end of the lift cords that extends out of the blind, the present cord lock and release system allows the lift cords to be freed from a locked position so that their position may be adjusted by pulling a linkage and their position may be locked by releasing the linkage. This is accomplished without the need to manipulate the lift cords.

Figure 1:
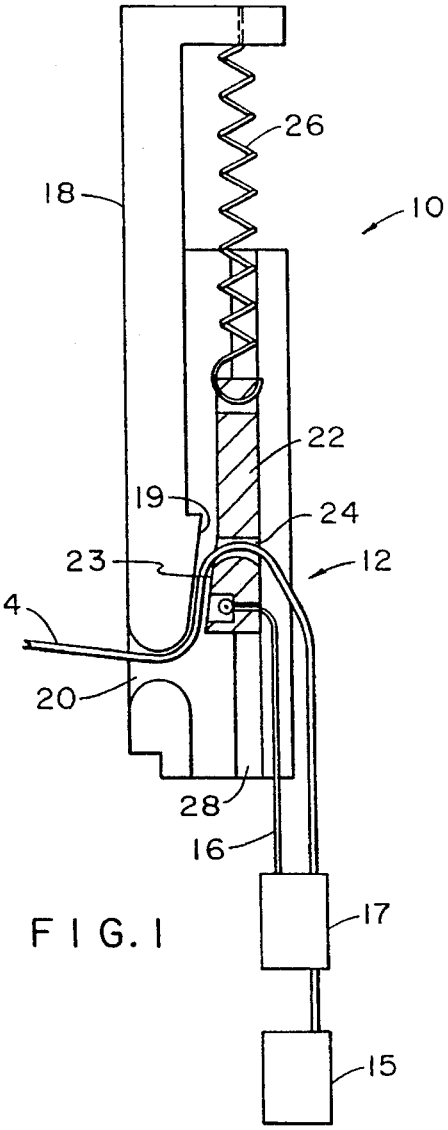
FIG. 1 is a longitudinal cross-sectional view of a first preferred cord lock and release system in a closed position.

Referring first to FIG. 1, a first preferred embodiment of a cord lock and release system 10 is shown for use in a blind assembly. The cord lock and release system 10 has a cord valve 12, through which at least one and usually two or more lift cords pass. For ease of illustration, only one cord 14 is shown in the drawings. A linkage 16 is connected to the cord valve 12. Cord valve 12 has a stationary housing 18 that is secured to the blind assembly and is thus prevented from moving. Stationary housing 18 has an opening 20 through which lift cord 14 is disposed. A planar slide plate 22 is situated in a plane that is adjacent to and parallel to stationary housing 18. Planar slide plate 22 has an opening 24 through which at least one cord 14 passes. A spring 26 is connected by any convenient means at one end to planar slide plate 22 and at its opposite end to a post that may extend from stationary housing 18 or the blind apparatus. Spring 26 is preferably an extension spring and is connected to planar slide plate 22 by any convenient means such as by fashioning a hook into the final turn of spring 26 and placing the hook through a hole in planar slide plate 22.

Figure 2:
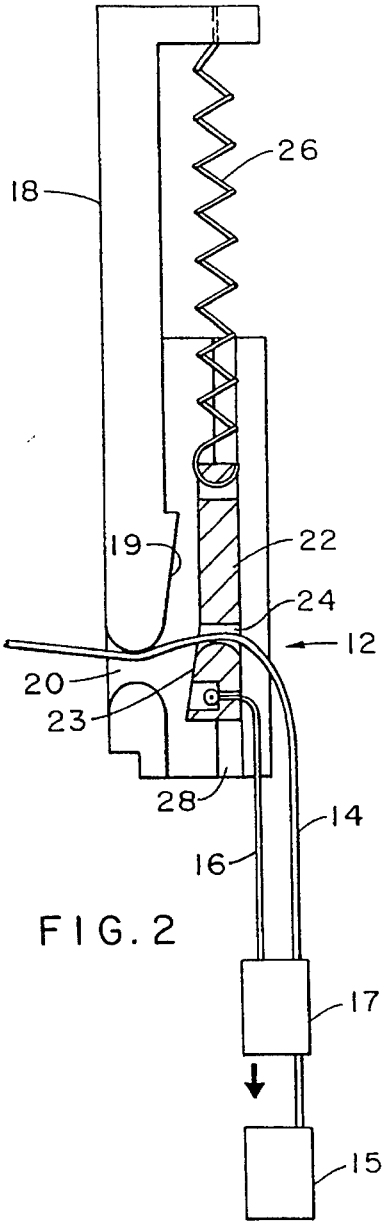
FIG. 2 a cross-sectional view similar to FIG. 1 showing the first preferred cord lock and release system in an open position.

When no external forces are acting on planar slide plate 22, spring 26 is in a contracted state which biases planar slide plate 22 into a predetermined offset or closed position relative to stationary housing 18, as shown in FIG. 2. Thus, a portion of planar slide plate 22 that bounds planar slide plate opening 24 is forced by spring 26 into contact with lift cord 14. This bounding portion of planar slide plate 22 is preferably smooth and formed without sharp edges. Planar slide plate 22 is preferably formed with a taper 23 along a surface of planar slide plate 22 that faces stationary housing 18. The portion of planar slide plate 22 that is tapered is adjacent to planar slide plate opening 24 and most proximate no stationary housing opening 20 when cord valve 12 is in the closed or locked position. The planar slide plate taper 23 extends angularly outward toward stationary housing 18 and downward away from spring 26. Lift cord 14 is then forced, by planar slide plate 22, into contact with a portion of stationary housing 18 that bounds stationary housing opening 20. This bounding portion of stationary housing 18 is also preferably smooth and formed without sharp edges that may damage lift cord 14. Stationary housing 18 is preferably formed with a taper 19 along the surface of stationary housing 18 that faces planar slide plate 22. The portion of stationary housing 18 that is tapered is adjacent to stationary housing opening 20 and nearest to planar slide plate opening 24 when cord valve 12 is in the closed or locked position. The stationary housing taper 19 extends angularly outward toward planar slide plate 22 and upward toward spring 26. The contact between planar slide plate 22, stationary housing 18 and lift cord 14 acts to grip lift cord 14 and prevent lift cord 14 from moving through stationary housing opening 20 and planar slide plate opening 24 and into the blind. Thus gripped, the blind is prevented from being covered. This gripping contact is made more effective by the stationary housing taper 19 moving towards planar slide plate taper 23. Therefore, when no external forces are acting on planar slide plate 22, and planar slide plate 22 is returned to its predetermined, spring-biased position, lift cord 14 is prevented from travel through the cord valve 12 into the window blind. Cord valve 12 is thus returned to its closed or locked position.

At least some portion of planar slide plate 22 is preferably situated within a track 28. Track 28 allows planar slide plate 22 and stationary housing 18 to remain at a fixed distance from one another and allows planar slide plate 22 to move in a plane that is parallel to stationary housing 18. The track can be provided in the sides 30 of the blind headrail (not shown) or sides attached to stationary housing 18. A linkage 16 is connected to planar slide plate 22 by any convenient means such as by gluing, tying or placing linkage 16 through a hole in planar slide plate 16 and placing a knot in the end of linkage 16 that is larger than the hole. The linkage is preferably a cord, but could also be assembled from one or more rigid members. The linkage 16 has a handle 17 attached to it by any convenient means which is accessible to the operator. The linkage handle 17 could hang freely from the linkage or be within or attached to the frame of a window to which the blind having our cord lock and release system is mounted.

Referring to FIG. 2, when the operator pulls linkage handle 17, linkage 16 is pulled and a force (shown by bold arrow in FIG. 2) acts on planar slide plate 22. This force acting on planar slide plate 22 causes planar slide plate 22 to move transverse and in a plane parallel to stationary housing 18 extending spring 26. As planar slide plate 22 is moved by linkage 16, the amount of offset between planar slide plate opening 24 and stationary housing opening 20 is reduced which reduces the amount of gripping on lift cord 14. If a sufficient force is applied at linkage 16, planar slide plate 22 is moved along track 28 to a position in which stationary housing opening 20 and planar slide plate opening 24 will be sufficiently aligned so that there is no longer any gripping contact between planar slide plate 22, stationary housing 18 and lift cord 14. When the lift cord 14 is no longer in sufficient gripped contact with the planar slide plate 22 and stationary housing 18 to keep lift cord 14 firmly held, the lift cord 14 is able to be freely moved through stationary housing opening 20 and planar slide plate opening 24. Then, cord valve 12 is said to be in an open position. Thus, when the weight of the blind provides a force on lift cord 14, lift cord 14 may be repositioned either slowly or quickly by simply applying an appropriate amount of force to linkage 16. The greater the amount of force on linkage 16, the more quickly lift cord 14 will travel through the cord valve 12. Thus, the amount of restriction on lift cord 14 may be varied directly by the amount of force applied to linkage 16 on cord valve 12. When linkage 16 is released, so that no external force is applied to planar slide plate 22, spring 26 will return to its contracted state. Cord valve 12 will thus be returned to a closed, locked position, and lift cord 14 will be locked in place.

The operator may cause the lift cord 14 to travel out of the blind, thus raising the blind whether the cord valve is in the locked or open position. In the open position, the lift cord is free to move in either direction. When the cord valve is in the locked position, a pulling force exerted on the lift cord 14 will pull planar slide plate 22 into a sufficiently open position so that lift cord 14 will travel out of the blind.

Figure 3:
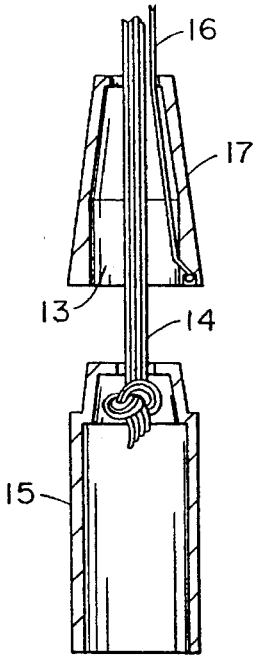
FIG. 3 is a front cross-sectional view of the preferred lift cord and weighted lift cord handle cooperating with the preferred a linkage and linkage handle.

In addition to being capable of varying the restriction of the lift cord 14 by varying the release force exerted at cord valve 12, the restriction of lift cord 14 could be varied at linkage handle 17. As seen in FIG. 3, linkage handle 17 is preferably a rigid member having an opening through it. The portion of lift cord 14 that extends out of the blind is placed through linkage handle opening 13. As the operator pulls linkage handle 17, lift cord 14 begins traveling through linkage handle opening 13 from the weight of the blind pulling the lift cord 14 into the blind. When the linkage handle 17 is tilted so that friction is felt between the lift cord 14 and the material around the linkage handle opening 13, the rate of travel of lift cord 14 will be slowed. Thus, the restriction of lift cord 14 is variable at linkage handle 17.

The lift cord 14 is provided with a weighted, tassel-like handle 15 attached by any convenient means to the end of lift cord 14 that is opposite to the end of lift cord 14 attached to the blind. Weighted lift cord handle 15 is weighted so that lift cord 14 will remain taut at all times and for any operation of the cord lock and release system. The weighting of weighted lift cord handle 15 is sufficient to keep lift cord 14 taut but is less than the amount of weight needed to overcome the biasing of cord valve 12 towards the locked position. Thus, when the window blind assembly is in the raised position and an external force is applied to linkage 16, lift cord 14 will travel through linkage handle 17 through cord valve 12 and into the blind as the blind is lowered. Weighted lift cord handle 15 will act as a stop such that when weighted lift cord handle 15 contacts linkage handle 17, lift cord 14 will be prevented from moving further into the blind and when the linkage handle 17 is released the cord valve will immediately close or lock and the blind will be prevented from being lowered further. The weighted lift cord handle 15 allows the lift cord length within the blind and therefore the length of the blind to be easily adjusted. By adjusting the position of weighted lift cord handle 15 relative no the headrail, the length of the lift cord 14 that can enter the blinds before weighted lift cord handle 15 contacts linkage handle 17 is adjusted, which determines the amount by which the blinds can be lowered.

Figure 4:
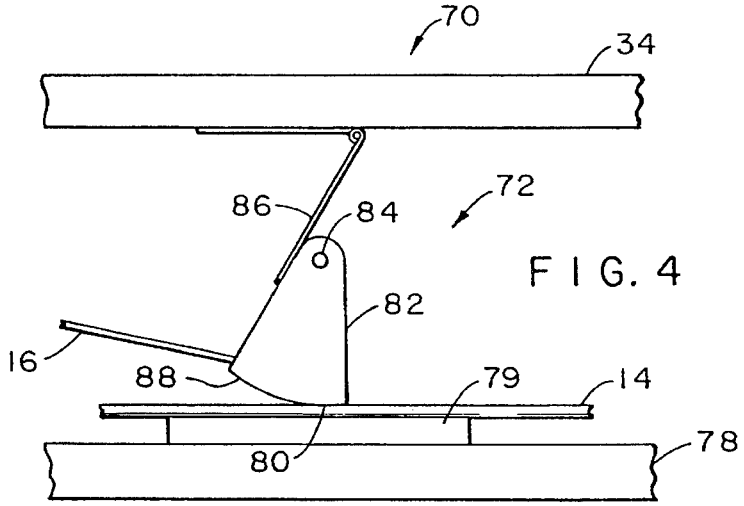
FIG. 4 is a side view of a second preferred cord lock and release system.

Referring next to FIG. 4, a second preferred embodiment of a cord lock and release system 70 is shown for use in a blind assembly. The cord lock and release system 70 has a cord valve 72, a lift cord 14 disposed through the cord valve 72 and a linkage 16 connected to the cord valve 72. Cord valve 72 has a cam-like tumbler 82 rotationally fixed to a tumbler pivot 84. Tumbler 82 has a preferable curved portion 88 that is distal to tumbler pivot 84. A stationary surface 78 that is fixed to the blind assembly and is thus prevented from moving lies below tumbler 82. An intermediary surface 79 that is made of an elastomeric material is placed between the tumbler 82 and stationary surface 78. Intermediary surface 79 is preferably placed upon but not fixed to stationary surface 78 so that intermediary surface 79 may translate across stationary surface 78 when subjected to a force. A spring 86 is fixed by any convenient means to the blind assembly 34 at one end and is connected to the tumbler 82 at its opposite end. Spring 86 may contact tumbler 82 or may be fixed to tumbler 82 by any convenient means. Spring 86 is designed such that when no external forces are acting on tumbler 82, spring 86 is in an extended state. In this extended state, spring 86 biases tumbler 82 so that tumbler clamp portion 80 contacts intermediary surface 79. Cord 14 is disposed between tumbler clamp portion 80 and intermediary surface 79. When tumbler clamp portion 80 is biased into contact with intermediary surface 79, cord 14 is gripped and is prevented from moving into the window blind which prevents the window blind from being lowered. Also, since intermediary surface 79 is made of an elastomeric material and since intermediary surface 79 is supported by stationary surface 78 which is rigid, intermediary surface 79 will compress slightly when pressure is applied from tumbler 82. As intermediary surface 79 deforms, lift cord 14 will be held by a greater surface area of intermediary surface 79 and tumbler 82, thus improving the gripping. By not fixing intermediary surface 79 to stationary surface 78 so that intermediary surface 79 can move slightly, when lift cord 14 is dragged across it with sufficient pressure from tumbler 82, the relative movement and thus the abrasion between lift cord 14 and intermediary surface 79 are reduced. This is because intermediary surface 79 and lift cord 14 move in the same direction as-the tumbler clamp portion 80 is moved into gripping contact with the moving lift cord 14. By moving in the same direction, there is less relative movement between the lift cord 14 and intermediary surface 79 which results in less friction and thus less wear of lift cord 14. In the same way, the relative movement and wear are reduced between the lift cord 14 and the intermediary surface 79 when the lift cord 14 is moved out of the window blind enough to begin moving through the cord valve. Thus, when no release force is acting on tumbler 82, cord 14 is restrained from moving into the blind and cord valve 72 is said to be in a closed, locked position.

A linkage 16 is connected to tumbler 82 by any convenient means such as by gluing or tying. The linkage is preferably a cord, but could also be assembled from one or more rigid members. When linkage 16 is pulled, an applied release force causes tumbler 82 to rotate about tumbler pivot 84. That rotation causes tumbler clamp portion 80 to move away from intermediary surface 79 contracting spring 86. When tumbler clamp portion 80 is not in sufficient biased contact with intermediary surface 79, lift cord 14 is able to travel into the window blind, allowing the blind to be lowered. In this state, cord valve 72 is said to be in an open position. As tumbler 82 is moved by linkage 16, the amount of rotation of tumbler 82 is increased which reduces the amount of gripping contact on lift cord 14. Thus, the amount of restriction on lift cord 14 may be varied directly by the amount of force applied at linkage 16. When linkage 16 is released, so that no release force is applied to tumbler 82, spring 86 will return to its extended state. Cord valve 72 will thus be returned to a closed, locked position. In the locked position, lift cord 14 will be prevented from moving into the blind which prevents the blind from being lowered.

The operator may cause the lift cord 14 to travel out of the blind, thus raising the blind whether the cord valve is in the locked or open position. In the open position, the lift cord is free to move in either direction. When the cord valve is in the locked position, a pulling force exerted on the lift cord 14 will cause tumbler 82 to rotate away from clamping contact with the lift cord 14 allowing the lift cord to travel out of the blind.

Figure 7:
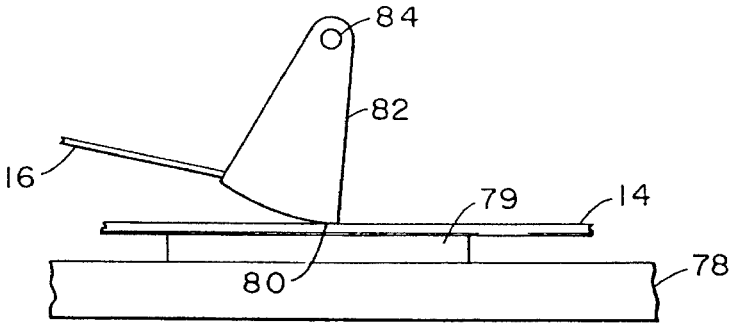
FIG. 7 is a side view of a variation of the second preferred cord lock and release system in which the tumbler is gravity-biased towards the intermediary surface.

Tumbler 82 can be biased towards intermediary surface 79 and lift cord 14 by means other than a separate spring 86. For example as shown in FIG. 7, gravity will bias tumbler clamp portion 80 to extend toward intermediary surface 79 when the cord lock and release system is oriented so that intermediary surface 79 is located below tumbler pivot 84. With tumbler clamp portion 80 in this gravity-biased position, frictional contact will occur between tumbler clamp portion 80 and lift cord 14 as lift cord 14 travels into the blind. The frictional contact between tumbler clamp portion 80 and lift cord 14 pulls tumbler 82 further towards intermediary surface 79 until lift cord 14 is gripped between tumbler clamp portion 80 and intermediary surface 79. In this gripped, locked position, lift cord 14 is unable to travel further into the blind. However, in the locked position, lift cord 14 is able to travel out of the blind since cord travel in this direction will result in frictional contact between the lift cord 14 and tumbler clamp portion 80 that will tend to move tumbler clamp portion 80 away from the intermediary surface 79. To release lift cord 14, the operator would apply a force to linkage 16 so that tumbler clamp portion 80 would pivot away from intermediary surface 79.

When the cord lock and release system is oriented so that intermediary surface 79 is not below tumbler pivot 84, a spring may be employed to bias tumbler clamp portion 80 towards intermediary surface 79. In this variation, the lift cord 14 is not held by spring-exerted gripping but rather the spring allows tumbler 82 to be in a position where the motion and friction of lift cord 14 on tumbler clamp portion 80 as lift cord 14 travels into the blind pulls tumbler 82 further towards intermediary surface 79 and into gripped contact with lift cord 14.

Figure 5:
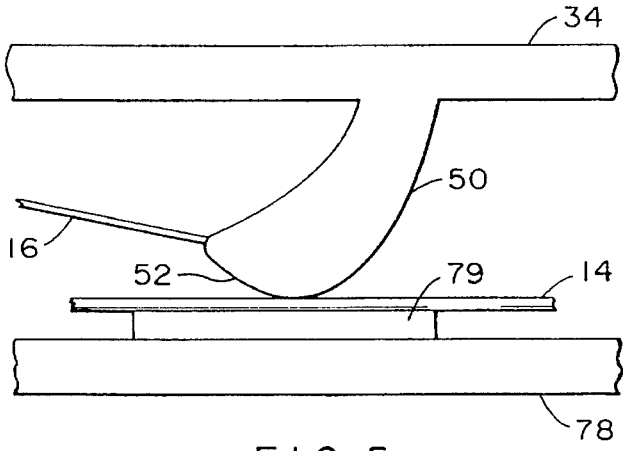
FIG. 5 is a side cross-sectional view of a variation of the second preferred cord lock and release system having a non-pivotable tumbler made of a resilient material.

Furthermore, as shown in FIG. 5, a separate spring and pivotable tumbler could be replaced by a one-piece tumbler 50 molded of a resilient material. The one-piece tumbler 50 would be fixed at one end to a stationary portion of the window blind assembly and would have a distal end-52 extend toward intermediary surface 79. Thus, the positioning of the one-piece tumbler 50 and the flexure of the resilient tumbler material will bias the one-piece tumbler 50 towards intermediary surface 79. When lift cord 14 moves into the blind between the one-piece tumbler 50 and the intermediary surface 79, the flexure of the resilient material as well as the frictional contact between the tumbler distal end 52 and the lift cord 14 will cause the distal end 52 to move further toward intermediary surface 79. The one-piece tumbler 50 will flex to accommodate any movement at the tumbler distal end 52. A linkage 16 would be provided at the one-piece tumbler 50 to move the distal end 52 away from the intermediary surface 79 when the operator desires to lower the window blinds.

Regardless of the design or orientation of the cord valve or the means chosen to bias the cord valve, an independent linkage is provided which, when activated by the operator, counters the bias and allows the cord valve to be placed into an open position.

This linkage preferably has a handle attached to it by any convenient means which is accessible to the operator. The linkage handle could hang freely from the linkage or be within or attached to the frame of a window to which the blind having our cord lock and release system is mounted. Thus, by pulling the linkage handle, the operator can apply a force to the linkage.

Thus, for each method of locking the lift cora, the restriction of the lift cord can be varied by varying the release force on the linkage. The restriction of the lift cord could also be varied at the linkage handle. In FIG. 3, the linkage handle is preferably a rigid member having an opening through it. The portion of lift cord 14 that extends out of the blind is placed through the linkage handle opening. Thus, as the lift cord travels through the linkage handle opening, the linkage handle can be tilted or positioned so that the lift cord will rub against the linkage handle material around the opening. This contact between the lift cord and the linkage handle will create friction which will slow the travel of the lift cord.

Figure 8:
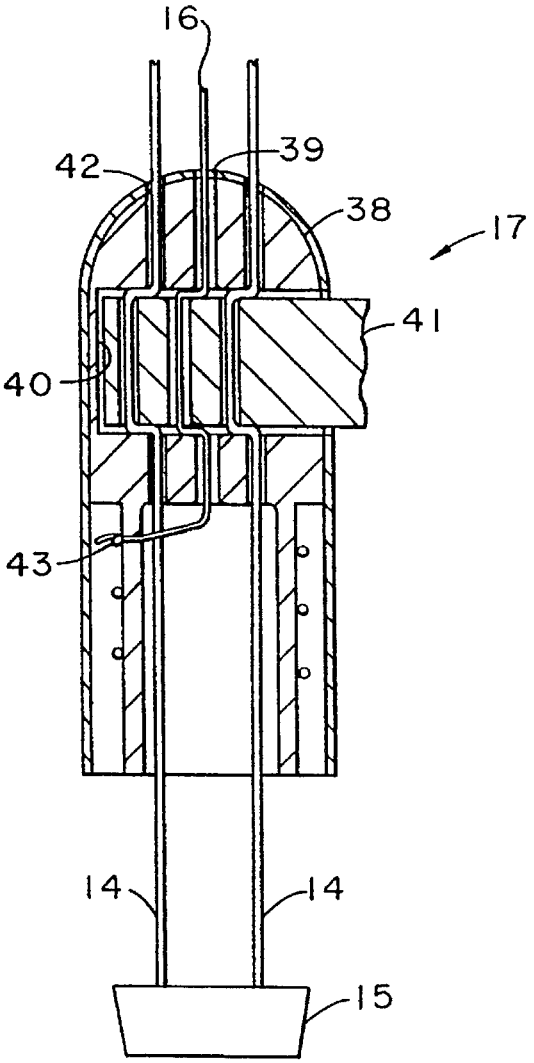
FIG. 8 is a front cross-sectional view of the linkage handle and the lift cord handle.

An alternative means of varying the restriction of the lift cord at the linkage handle is shown in FIG. 8. Linkage handle 17 has a handle body 38 having a linkage passage 39 disposed through it. Handle body 38 further has lift cord passages 42 disposed through it. Handle body 38 further has a button cavity 40 disposed through it. A button 41 is disposed within button cavity 40. Button 41 also has a linkage passage and lift cord passage 42 disposed through it. When button 41 is put into a restraining position as shown in FIG. 8, the lift cord passages 42 of the handle body 38 and button 41 will be offset which will cause the lift cords to be gripped between the button and the handle body. When pressure is removed from button 41, the tension in the lift cords will cause button 41 to be moved away from the restraining position. The linkage will be disposed through the linkage passages and will be adjustably fixed around a portion of the handle body by any convenient means such as by tying a knot 43 into the end of the linkage. Lift cord 14 is connected to lift cord handle 15 by any means, such as by tying a knot at the end of the cord (not shown).

Figure 9:
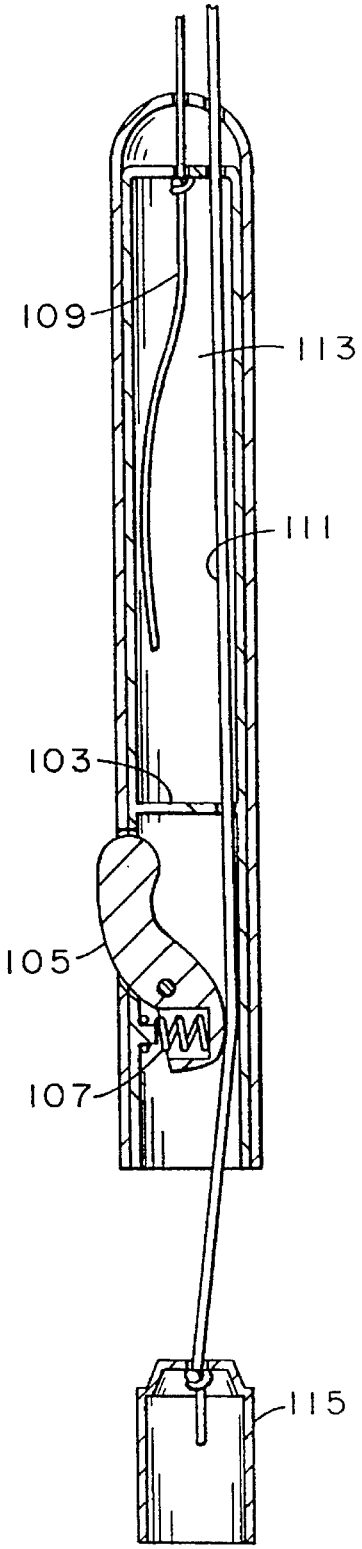
FIG. 9 is a front cross-sectional view of another variation of the linkage handle and the lift cord handle.

Another alternative means of varying the restriction of the lift cord at the linkage handle is shown in FIG. 9. A cam button 105 may be rotatably disposed within linkage handle 103. Cam button 105 is biased by a spring 107 away from contact with the interior wall of the linkage handle 103. The lift cord 111 is disposed between the cam button and the wall of the linkage handle and fixed to lift cord handle 115 by any convenient means such as by tying a knot in the end of the lift cord. Linkage 109 is connected to linkage handle 113 by any convenient means by pressing cam button 105. The cam button will rotate towards the wall of the linkage handle which will cause the lift cord to be restricted within the linkage handle.

The lift cord will also have a handle attached by any convenient means to the end of the lift cord which extends out of the blind. As the lift cord travels through the linkage handle and into the blind lowering the blind, the weighted lift cord handle will eventually contact the linkage handle. When the weighted lift cord handle contacts the linkage handle, the blinds will be prevented from being lowered further.

Figure 6:
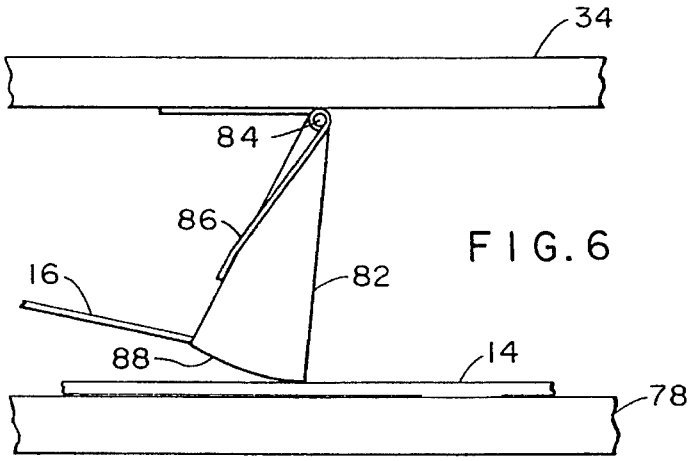
FIG. 6 is a side view of a variation of the second preferred cord lock and release system in which tumbler contact is made directly the stationary surface.

Variations of the foregoing embodiments could be made. For example, as shown in FIG. 6, the cam-like valve of the second preferred embodiment need not utilize an intermediary surface. Thus, lift cord 14 would be held between tumbler 82 and stationary surface 78 when in the locked position.

Also, although a coil spring 26 is employed to bias the cord valve 12 of the first preferred embodiment, any type of spring could be used if properly positioned on the valve. Similarly, although a coil spring 86 is used to bias cord valve 72, any type of spring could be used.

Furthermore, for any spring-loaded, gripping embodiment such as the first preferred embodiment, the stationary and movable plates need not move linearly relative to one another. The movable plate could be pivotably attached to the stationary plate so as to allow rotational movement of the movable plate.

And, tumbler 82 could also be mounted to provide a guillotine type action in which the entire tumbler would move through a plane which intersects the stationary surface 78. An example of this variation would be a roller in a track capable of moving linearly.

Also, although tumbler clamp portion 80 of cord valve 72 is preferably smooth and curved, it may have serrations for additional gripping.

A third preferred cord lock and release system is now described with reference to FIGS. 10 through 15. This embodiment utilizes a generally cylindrical locking pin 120 (shown individually in FIG. 15) working in cooperation with a movable notched sidewall segment 122 (shown individually in FIG. 14) and a stationary structure 124 (shown individually in FIG. 13).

As can be seen best in FIGS. 11 and 13, the stationary structure 124 has two spaced apart and generally parallel planar sidewalls 126 (one of which is shown in the cross-sectional view of FIG. 13). Disposed upon each sidewall 126 is an angled and preferably generally arcuate groove 128. The groove 128 is shaped the same for each sidewall 126 and is located on the same position on each sidewall 126 so that the grooves 128 are opposed and are mirror images of one another.

The two sidewalls 126 of the stationary structure 124 are fixed relative to one another, preferably by transverse bottom wall 130 and transverse top wall 132. It is also preferred that a transverse rear wall 134 also connects each sidewall 126 of the stationary structure 124. It is further preferred that transverse rear wall 134 does not extend entirely between the transverse bottom wall 130 and the transverse top wall 132 leaving an inlet 136 through which the lift cord 14 and any other linkage (such as release cord 158) may pass. A transverse front wall 138 also preferably connects the two sidewalls 126 of the stationary structure 124. Preferably, the transverse front wall 138 does not extend completely between the transverse bottom wall 130 and the transverse top wall 132 thereby leaving an outlet 140 through which a lift cord 14 or any other linkage may pass. Thus, walls of the stationary structure 124 define a volume that extends in a longitudinal direction between the two opposed sidewalls 126.

An optional longitudinally extending guidepost 142 may extend from the transverse rear wall 134 to the transverse front wall 138. The guidepost 142 allows a spring 156 (shown in FIG. 10) to be disposed around it to secure the position of the spring 156 within the stationary structure 124. A transverse post 144 is also preferably provided between the opposed sidewalls 126 of the stationary structure 124. The transverse post 144 may be formed from part of the transverse rear wall 124 or may be separate. An additional transverse post 145 is also preferably provided between the opposed sidewalls 126.

Referring next to FIGS. 10, 11 and 12, the movable segment 122 is movably seated within stationary structure 124. The movable segment 122 may slide linearly in the directions indicated by the dotted arrows of FIGS. 10 and 12.

Referring now to FIGS. 10, 11 and 14, the movable segment 122 has two opposed, generally planar sidewalls 146. Each movable segment sidewall 146 has a notch 148 disposed thereon. The notches 148 extend in a direction generally perpendicular to the direction of movement of the movable segment 122 relative to the stationary structure 124. The notches 148 are shaped the same for each sidewall 146 and are located in the same position on each sidewall 146 so that the notches 148 are opposed and are mirror images of one another. The movable segment 122 has a transverse bottom surface 150 connecting the two sidewalls 146. The movable segment 122 also preferably has a transverse spring wall 152 connection the two sidewalls 146. Therefore, when spring 156 is provided around guidepost 142 of the stationary structure 124 one end of the spring abuts the transverse rear wall 134 of the stationary structure 124 and the other end of the spring 156 abuts the spring wall 152 of the movable segment 122. Thus, spring 156 tends to bias the movable segment 122 toward the transverse front wall 138 of the stationary structure in the direction of the dotted arrow of FIG. 10 and away from the transverse rear wall 134 of the stationary structure. Movable segment 122 further is provided with a transverse post 154 to be used in cooperation with transverse posts 144 and 145 for connection and operation of the release cord 158 to the movable segment 122 as will be discussed more fully below.

Referring next to FIGS. 10, 11 and 15, a generally cylindrical locking pin 120 is movably connected to the stationary structure 124 and the movable segment 122. The locking pin 120 has two narrow portions 160 provided at some distance from one another. Between the two narrow portions 160 is the contacting portion 162 of the locking pin 120. The contacting portion 162 of the locking pin 120 is preferably textured to provide additional gripping when the contacting portion 162 is in contact with the lift cord 14. The locking pin 120 is movably disposed within the movable segment 122 by providing each narrow portion 160 within the notch 148 of the movable segment sidewall 146. The diameter of the locking pin narrow portions 160 is less than the width of the notch 148 in the movable segment sidewall 146. On each end of the locking pin 120 is a respective end portion 164. End portions 164 are disposed within respective grooves 128 of the stationary structure sidewalls 126. The diameter of the locking pin end portions 164 is less than the width of the stationary structure sidewall grooves 128 so that the locking pin 120 may slide along grooves 128. Preferably, pin contacting portion 162 is designed to have a diameter greater than the width of movable segment notches 148, so that locking pin 120 is movably secured to the movable segment 122 and the stationary structure 124.

Referring to FIG. 10, when there is no force acting on the release cord 158, spring 156 biases the movable segment 122 to move forward linearly relative to the stationary structure 124 in the direction indicated by the dotted arrow of FIG. 10. Locking pin 120 is thereby forced to follow the path of groove 128 in the stationary structure sidewall 126. As can be seen in FIG. 10, stationary sidewall groove 128 is designed to extend downward at an angle toward the lift cord 14. Thus, as the movable segment 122 is moved forward within the stationary structure 124 in the direction indicated by the dotted arrow of FIG. 10, locking pin 120 follows the path of groove 128 and moves downward within the notch 148 of the movable segment sidewalls 146. Locking pin 120 is forced downward into contact with the lift cord 14, pinching the lift cord 14 between the locking pin 120 and the transverse bottom surface 150 of movable segment 122. With the lift cord 14 thus held between the locking pin 120 and the bottom holding surface 150, the locking pin 120 is said to be in a locked position.

Referring next to FIG. 12, when a pulling force sufficient to overcome the bias force of spring 156 is applied to release cord 158, spring 156 is compressed and the movable segment 122 is caused to move linearly in the direction indicated by the dotted arrow of FIG. 12. When the movable segment 122 moves in this direction, locking pin 120 follows the groove 128 of the stationary structure 124 and moves preferably arcuately upward away from the lift cords 14. As the locking pin 120 is moved arcuately upward within groove 128 of the stationary structure 124, the locking pin 120 simultaneously moves upward within the notch 148 of the movable segment 122. With the locking pin 120 thus moved away from lift cord 14, lift cord 14 may freely move into and out of the stationary structure 124 and the locking pin 120 is said to be in the open position. When the pulling force is removed from the release cord 158, the spring 156 again extends and biases the movable segment 122 forward causing the lift cord 14 to be locked.

Although the lift cord 14 is shown as being gripped between the locking pin 120 and the bottom holding surface 150 in the locked position, it is understood that the cord lock and release system could be alternatively designed to grip the lift cord 14 between the locking pin 120 and the transverse bottom wall 130 of the stationary structure 124 without departing from the spirit of the invention by simply removing at least some portion of the bottom surface 150. Furthermore, it is understood that when the stationary structure 124 is mounted on the headrail, a portion of both the bottom surface 150 and the transverse bottom wall 130 may be removed so that the lift cord 14 is held between the locking pin 120 and the headrail. Furthermore, an intermediate surface (not shown) may be inserted upon any of the bottom surfaces, the transverse bottom wall 130 and the headrail to supply the surface in which the lift cord 14 lies upon in the locked position.

The release cord 158 may be connected to the movable segment 122 by any convenient means, however, care should be taken to avoid tangling between the release cord 158 and the lift cord 14. A preferred manner of connecting the release cord 158 to the movable member 122 that prevents tangling of the release cord 158 with the lift cord 14 and also provides a means of varying the response of the cord lock and release system to the distance that the release cord 158 is pulled is provided herein. As can be seen in FIG. 10, the release cord 158 enters the inlet 136 of the stationary structure 124 on one side of the additional transverse post 145 so that transverse post 145 separates the release cord 158 from the lift cord 14. Release cord 158 is then looped around transverse post 154 on the movable segment 122. The release cord 158 is then connected to the stationary structure 124 such as by being connected to transverse post 144 or trapped between post 144 and backwall 134. Release cord 158 may be connected to transverse post 144 by any convenient means such as by tying the end of release cord 158 into a knot. The result of looping the release cord 158 around the transverse posts is that when release cord 158 is pulled a selected distance, the movable segment will move a lesser distance. Thus, finer movements of the movable segment and finer operation of the cord lock and release system may be achieved by an operator. Furthermore, release cord 158 may be looped more than once around the guideposts.

Referring next to FIGS. 16 and 17, a fourth preferred cord lock and release system is shown. Similarly to the third preferred embodiment, the fourth embodiment utilizes the cooperation of a movable segment 190, a stationary structure 180 and a locking pin 198. The stationary structure 180 is similar to the stationary structure 124 of the third preferred embodiment described above. Stationary structure 180 has a pair of opposed planar sidewalls 182, each having an arcuate groove 184 disposed thereon. The grooves 184 sized and positioned the same on each sidewall 182 so as to be mirror images of one another. The stationary structure 180 has a transverse bottom surface 186 which connects each of the opposed sidewalls 182. The stationary structure 180 may also have other transverse walls (not shown) connecting the sidewalls 182. However, it is preferred that a transverse upper wall 187 connects the two sidewalls 182. The stationary structure 180 has openings at the front and rear thereof to allow lift cord 14 and release cord 202 to travel therethrough. This may be accomplished by simply not providing the stationary structure 180 with front and rear transverse walls (as is shown in the figures). The stationary structure 180 also has a transverse post 188 connecting each of the opposed sidewalls 182.

The movable segment 190 is pivotably connected to the stationary structure 180 by pivotal connection 192. The movable segment 190 is shaped like a cam. One end of the movable segment 190, at some distance from the pivotal connection 192, has a notch 194 provided thereon. Notch 194 is sized and configured so as to contain locking pin 198. A transverse post 196 is also provided on the movable segment 190.

Locking pin 198 is disposed through notch 194 of the movable segment 190 and through the slots 184 of the stationary structure 180. Locking pin 198 is substantially identical to locking pin 120 shown in FIG. 15 of the third preferred embodiment. Thus, locking pin 198 may be controlled by movable segment 190 at any position (see FIG. 15). A spring 200 is connected to the stationary structure 180, preferably at transverse upper wall 187, and the movable segment 190 biasing the movable segment 190, rotationally downward toward lift cord 14. Spring 200 is preferably a clothespin-type spring. A release cord 202 is engaged with the movable segment 190 at transverse post 196. Transverse post 196 and transverse post 189 allow for a varying amount of movement of the movable segment 190 with a force applied to the release cord 202 as will be discussed more fully below.

When there is no force acting on release cord 202 spring 200 biases the movable segment 190 rotationally downward about pivotal connection 192 toward lift cord 14. Movable segment 190, in turn, moves locking pin 190 through slots 184 of the stationary structure 180 angularly downward as well. With the locking pin 198 forced downward thus, lift cord 14 is locked between locking pin 198 and holding surface 186 ultimately by the wedging force induced on the lift cord by the holding surface and the locking member by the friction between the cord and the locking member. In this locked position, lift cord 14 is unable to move towards the shade but is free to move out of the shade when pulled by the operator.

Referring next to FIG. 17 when a pulling force is applied to release cord 202, sufficient to overcome the biasing force applied by spring 200 and the wedging force of the lock pin and the holding surface on the cord lock, movable segment 190 is caused to rotate upward about pivotal connection 192 away from lift cord 14. With locking pin 198 at some distance from the holding surface 186, the locking pin is said to be in an open position in which the lift cord 14 is able to freely move into and out of the stationary structure 180.

Although the preferred means for biasing movable segment 190 downward is spring 200, when the movable segment 190 is oriented as shown in FIGS. 16 and 17 (i.e., vertically in relation to the ground when in the locked position), the movable segments may be gravity-biased downward.

As described with reference to the preceding third embodiment, the lift cord 14 need not be held by transverse bottom surface 186 in the presently-described fourth embodiment. As mentioned, a portion of the bottom surface 186 may be removed so that the lift cord 14 is held between the locking pin 198 and the headrail (when the stationary structure 180 is mounted on the headrail). Also, an intermediate surface of soft or textured material (not shown) may be provided on either the bottom surface 186 or the headrail.

As described with reference to the preceding third embodiment, release cord 202 may be connected to the movable segment 190 by any convenient means, however, a preferred means is provided herein. Again, the release cord 202 enters the stationary structure 180 on one side of a transverse post 189 such that transverse post 189 separates release cord 202 from lift cord 14. Release cord 202 is then looped around a transverse post 196 on the movable segment 190. Release cord 202 is then connected to the stationary structure 180 such as by being tied to transverse post 188 on the stationary structure 180 or mushroomed as shown. As noted above, the release cord 202 may be looped any number of times around the transverse posts.

Figure 18:
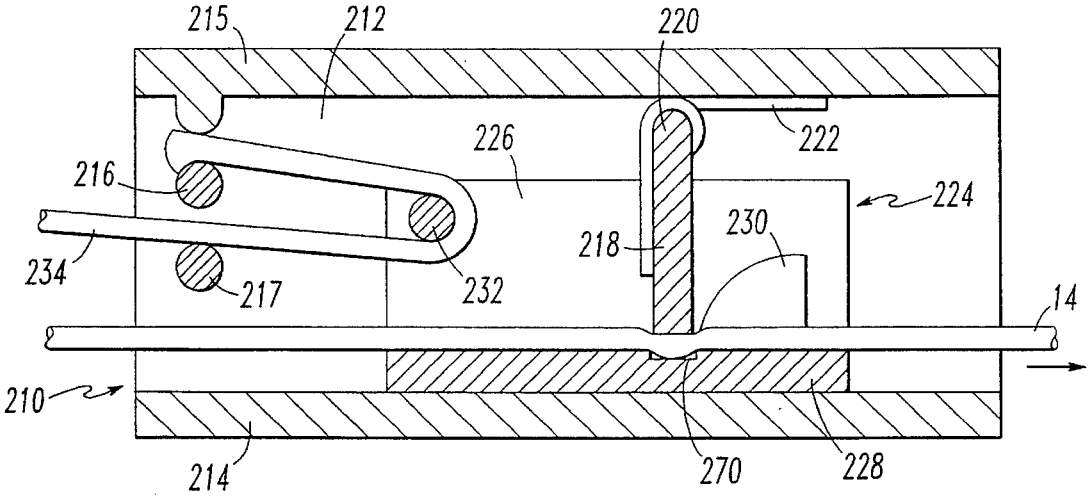
FIG. 18 is a side cross-sectional view of a fifth preferred cord lock and release system in the locked position.
Figure 19:
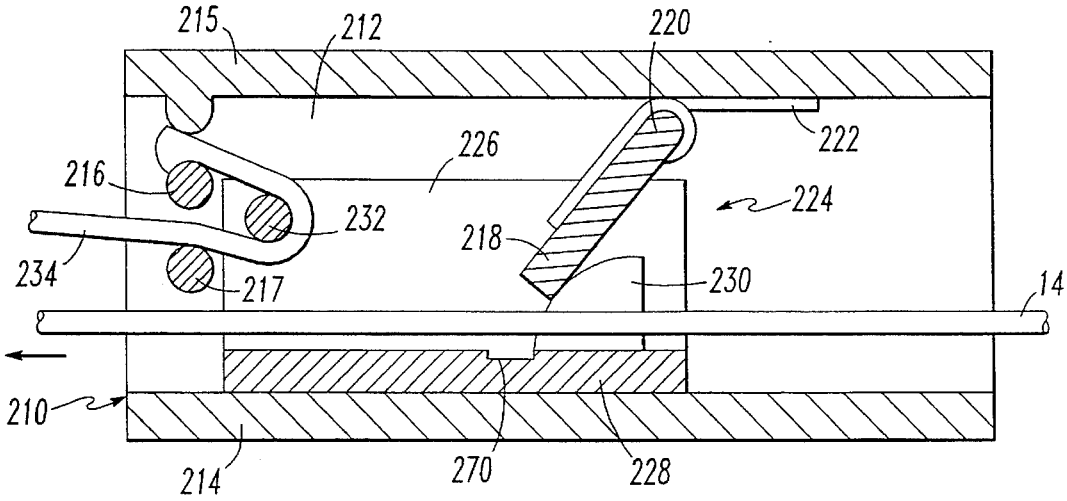
FIG. 19 is a view similar to FIG. 18 of the cord lock and release system in the open position.

Referring next to FIGS. 18 and 19 a fifth preferred embodiment of the cord lock and release system is shown. Again, the main components of this embodiment are a movable segment 224, a stationary structure 210 and a locking member 218. In this embodiment, the stationary structure 210 has at least one and preferably two opposed planar sidewalls 212. The stationary structure 210 preferably also has a transverse bottom wall 214 connecting the opposed sidewalls 212. A transverse post 216 may also be provided, connecting the two sidewalls 212.

A cam 218, utilized as the locking member, is pivotably connected to the stationary structure 210, preferably at the sidewalls 212, by a pivotal connection 220. A spring 222 is connected to the stationary structure 210 and to the locking cam 218, biasing the locking cam 218 arcuately downward about pivotal connection 220 toward lift cord 14. The spring 222, which is preferably a clothespin-type spring, may be connected to the stationary structure 210 at a transverse upper wall 215.

A movable segment 224 is slidably disposed within the stationary structure 210 so as to be able to move linearly relative to the stationary structure 210 in the longitudinal direction indicated by the bold arrows of FIGS. 18 and 19. Movable segment 224 has at least one planar sidewall 226 and preferably has two opposed planar sidewalls 226. The sidewalls 226 of the movable segment preferably are disposed adjacent to respective sidewalls 212 of the stationary structure 210. Movable segment 224 preferably has a transverse bottom holding surface 228 connecting the opposed sidewalls 226. Extending outward from the transverse bottom holding surface 228 is at least one extension 230. Preferably two extensions 230 extend upward from the transverse bottom holding surface 228 on either side of the lift cord 14. The extensions 230 are preferably curved as shown in the figures. The extensions 230 are designed to have the same profile and are located in the same longitudinal position so as to be mirror images of one another. Although it is preferred that extensions 230 extend from the bottom holding surface 228, it is understood that the extensions 230 may extend outward from the sidewalls 226 of the movable segment or from a front or rear wall (not shown) of the movable segment 224.

The movable segment 224 further has a transverse post 232 provided thereon connecting the two opposed sidewalls 226. Transverse posts 216, 217 and 232 will cooperate as described more fully below to vary the distance that the movable segment 224 moves as a result of the distance that release cord 234 is pulled. Release cord 234 is connected to the movable segment 224 at transverse post 232.

When no force is applied upon release cord 234 spring 222 biases the locking cam to pivot arcuately downward about pivotable connection 220 towards lift cord 14. Locking cam 218 simultaneously contacts extensions 230 causing the movable segment 224 to move linearly in the direction indicated by the bold arrow of FIG. 18. With the spring 228 biasing the locking cam 218 downward into contact with lift cord 14, lift cord 14 engages the locking cam 218 and holding surface 228. With the lift cord 14 thus held, the locking cam 218 is said to be in a locked position.

A pulling force is applied to release cord 234 as shown in FIG. 19. When the release cord 234 is pulled sufficiently to overcome the biasing force provided by spring 222 and the wedging force of the locking cam, the movable segment 224 moves linearly in relation to the stationary structure 210 in the direction of the bold arrows of FIG. 19. The extensions 230 contact the locking cam 218 causing the locking cam 218 to pivot arcuately upward about pivotal connection 220. As the locking cam 218 is rotated away from lift cord 14 and holding surface 228, the lift cord 14 is released and is able to move freely into and out of the stationary structure 210. With the lift cord 14 able to move thus, the locking cam 218 is said to be in the open position.

As noted, the stationary structure 210 and the movable segment 224 preferably have a pair of opposed sidewalls each (212, 226, respectively). However, it was further noted that the stationary structure 210 and movable segment 224 may each have only one sidewall. In fact, the movable segment 224 may be designed to have no sidewalls 226 so that extensions 230 are connected to the bottom holding surface 228 which is, in turn, connected to the release cord 234. However, some means must be provided for allowing the movable segment 224 to be movably secured to the stationary structure 210.

As described above with reference to the third and fourth embodiments, a portion of transverse bottom holding surface 228 may be removed so that it no longer extends entirely across between the two sidewalls 226 of the movable segment 224. Instead, the lift cord 14 may lie directly upon the bottom wall 214 of the stationary structure 210. In this alternative, the lift cord 14 will be locked by contact between the locking cam 218 and the bottom wall 214 of the stationary structure 210. As it is understood that the stationary structure may be the headrail itself, bottom wall 214 of the stationary structure 210 may be a surface of the headrail. When the stationary structure 210 is mounted on the headrail, a portion of both bottom surface 228 and bottom wall 214 may be removed so that the lift cord 14 lies upon the headrail and is locked between the locking cam 218 and the headrail. Furthermore, an intermediate surface (not shown) may be provided upon any one of the bottom surface 228, the bottom wall 214 and the headrail, providing the holding surface.

As described above with reference to the third and fourth embodiments, the release cord 234 may be connected to the movable segment 224 by any convenient means, however, a preferred means is provided. Release cord 234 enters the stationary structure 210 on one side of a transverse post 217 such that transverse post 217 separates release cord 234 and lift cord 14. Release cord 234 is then looped around transverse post 232 on the movable segment 224. Release cord 234 is then connected to the stationary structure 210. Release cord 234 may be connected to stationary structure 210 by any convenient means but is preferably connected to transverse post 216 such as by tying release cord 234 in a knot or mushrooming the end. As noted above, the release cord 234 may be looped any number of times around the transverse posts.

A sixth preferred embodiment of the cord lock and release system is now described with reference to FIGS. 20 and 21. As with the third, fourth and fifth preferred embodiments described above, the main components of this embodiment are a movable member, a stationary structure and a locking member. In this embodiment, the stationary structure 240 is similar to the stationary structure 210 of the fifth preferred embodiment in that the stationary structure 240 has at least one and preferably two planar sidewalls 242. A transverse bottom wall 244 of the stationary structure 240 may be provided, connecting the two opposed sidewalls 242. The stationary structure 240 may further have a transverse top wall 246 connecting the two opposed sidewalls 242. It is preferred that the stationary structure 240 also have a transverse post 248 connecting the two sidewalls 242.

A locking cam 250 is utilized as the locking member in this embodiment and is pivotably connected to the stationary structure 240, preferably at the sidewalls 242, by a pivotal connection 252. A spring 254 is connected to the stationary structure 240 and to the locking cam 250, biasing the locking cam 250 arcuately downward about pivotal connection 252 toward the lift cord 14. Spring 254 is preferably a clothes-pin-type spring and may be connected to the stationary structure 240 at the transverse top wall 246.

Figure 20:
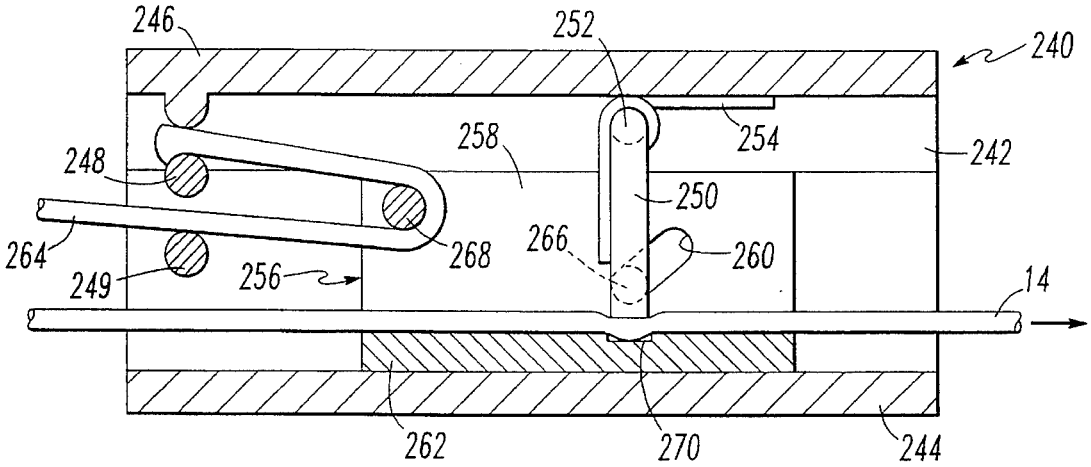
FIG. 20 is a side cross-sectional view of a sixth preferred cord lock and release system in the locked position.
Figure 21:
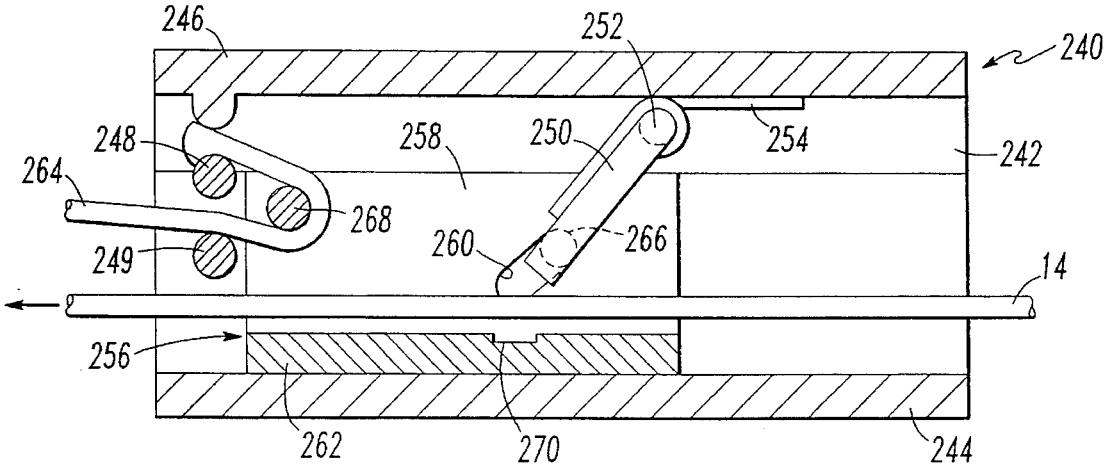
FIG. 21 is a view similar to FIG. 20 of the cord lock and release system in the open position.

A movable segment 256 is slidably disposed within the stationary structure 240 so as to be able to move linearly relative to the stationary structure 240 in the longitudinal direction indicated by the dotted arrows of FIGS. 20 and 21. The movable segment 256 has two opposed generally planar sidewalls 258. Each movable segment sidewall 258 has a notch 260 disposed thereon. The notches 260 may be perpendicular relative to the lift cord 14 but are preferably angled or generally arcuate. The notches 260 are shaped the same for each sidewall 258 and are located on the same position on each sidewall 258 so that the notches 260 are opposed and are mirror images of one another. The movable segment 256 has a transverse bottom surface 262 connecting the two sidewalls 258. The movable segment 256 may also have a partial transverse upper wall, a transverse front wall and/or a transverse rear wall (not shown). It is understood, however, that if front and rear transverse walls are provided on the movable segment 256, portions will be removed so that the lift cord 14 and release cord 264 may be disposed therethrough.

The locking cam 250 has at least one and preferably two guide extensions 266 extending transversely therefrom at some distance from the pivotal connection 252. The guide extensions 266 are disposed through each of the respective notches 260 in the movable segment sidewalls 258. As can be seen in FIGS. 20 and 21, the locking cam 250, the pivotal connection 252, the guide extensions 266 and the sidewall notches 260 are designed so that guide extensions 266 may travel through the notches 260 and the locking cam 250 may pivot when the movable segment 256 is moved.

Referring to FIG. 20, when there is no force acting on the release cord 264, spring 254 biases the locking cam 250 angularly downward about pivot connection 252 toward the lift cord 14. As the locking cam 250 pivots downward, guide extensions 266 travels down notches 260 causing movable segment 256 to move linearly forward in the stationary structure 240 in the direction indicated by the dotted arrow of FIG. 20. The locking cam 250 pivots angularly downward until it engages the lift cord 14. The lift cord 14 is thus prevented from moving by contact between the locking cam 250 and the transverse bottom surface 262 of the movable segment 256. With the lift cord 14 thus held between the locking cam 250 and the transverse bottom surface 262, the locking cam 250 is said to be in a locked position. Alternately, or additionally, movable segment 256 may be biased directly, such as by a spring (not shown) connecting the movable segment 256 and the stationary structure 240.

Referring next to FIG. 21, when a pulling force sufficient to overcome the bias force of spring 254 is applied to release cord 264, spring 254 is extended and the movable segment 256 is caused to move linearly rearward in the stationary structure 240 in the direction indicated by the dotted arrow of FIG. 21. When the movable segment 256 moves in this direction, guide extensions 266 are forced to travel angularly upward along notch 260 which causes locking cam 250 to pivot arcuately upward about pivotal connection 252 and away from lift cord 14. With the locking cam 250 thus moved away from lift cord 14, lift cord 14 may freely move into and out of the stationary structure 240 and the locking cam 250 is said to be in the open position. When the pulling force is removed from the-release cord 264, the spring 254 again biases the locking cam 250 arcuately downward into locking engagement with the lift cord 14. As the locking cam 250 is moved angularly downward, the movable segment 256 is simultaneously returned to the forward position relative to the stationary structure 240.

As described with reference to the preceding third, fourth and fifth embodiments, although the lift cord 14 is shown as being gripped between the locking cam 250 and the transverse bottom surface 262 in the locked position, it is understood that the cord lock and release system could be alternatively designed to grip the lift cord 14 between the locking cam 250 and the transverse bottom wall 244 of the stationary structure 240 by simply removing at least some portion of the transverse bottom surface 262. As it is understood that the stationary structure 240 may be the headrail itself, transverse bottom wall 244 of the stationary structure 240 may be a surface of the headrail. When the stationary structure 240 is mounted on the headrail, a portion of both transverse bottom surface 262 of the movable segment 256 as well as the transverse bottom wall 244 of the stationary structure 240 may be removed so that the lift cord 14 lies upon the headrail and is locked between the locking cam 250 and the headrail. Furthermore, an intermediate surface (not shown) may be provided upon any one of the bottom surface 262, the bottom wall 244 and the headrail, providing the holding surface.

As described above with reference to the third, fourth and fifth embodiments, the release cord 264 may be connected to the movable segment 256 by any convenient means. A preferred means for connecting the release cord 264 to the movable segment 256 involves the use of transverse post 268 on movable segment 256 and transverse posts 248 and 249 on stationary structure 240. Release cord 264 enters the stationary structure 240 on one side of transverse post 249, such that transverse post 249 separates release cord 264 and lift cord 14. Release cord 264 is then looped around transverse posts 268 on movable segment 256. Release cord 264 is then connected to the stationary structure 240 by any convenient means, but is preferably connected to transverse post 248 such as by tying release cord 264 in a knot. The release cord 264 may be looped any number of times around the transverse posts.

The holding surface of each of the preceding embodiments may be provided with an indentation. The indentation shown as 270 in FIGS. 18, 19, 20 and 21 is provided at a location of the holding surface so that when the locking member is in the locking position, the portion of the lift cord 14 being gripped between the locking member and the holding surface lies upon the indentation 270. Indentation 270 allows the lift cord 14 to be more effectively held in the locking position.

In the third, fifth and sixth embodiments, it is preferred that the holding surface be a lower transverse wall of the movable member. This is because it is preferred that the holding surface move in unison with the locking member and the lift cords. Such uniform movement reduces wear on the lift cords.

It is understood that although one lift cord has been described for ease of description, any number of lift cords may be employed in the blind assembly in which the cord lock and release system is used.

While certain present preferred embodiments have been shown and described, it is distinctly understood that the invention is not limited thereto but may be otherwise embodied within the scope of the following claims.

I claim:

1. A cord lock and release system comprising:

(a) a stationary structure;

(b) a movable segment that is movable between a first position and a second position relative to said stationary structure;

(c) a locking member movably connected to said stationary structure so as to be movable along a preselected path relative to said stationary structure;

(d) a release linkage connected at one end to said movable segment and accessible by an operator at an opposite end for moving said movable segment into said first position; and (e) means for biasing said movable segment into said second position;

(f) at least one lift cord provided between said locking member and a holding surface;

wherein when said movable segment is in said first position relative to said stationary structure, said movable segment moves said locking member along said preselected path into an open position such that a portion of said at least one lift cord can move between said locking member and a holding surface; and wherein when said movable segment is biased into said second position relative to said stationary structure, means for biasing said locking member along said preselected path into a locked position cause said lift cords to be restrained by frictional contact between said locking member and said holding surface.

2. The cord lock and release system of claim 1 in combination with a window blind assembly, the window blind assembly being of the type in which the lift cords are connected at one end to window blinds and extend through an upper, fixed headrail of the window blind assembly, wherein said stationary structure is the headrail of the window blind assembly.

3. The cord lock and release system of claim 1 wherein said stationary structure is a housing.

4. The cord lock and release system of claim 3 wherein said housing is affixed to a bracket.

5. The cord lock and release system of claim 1 wherein said holding surface is one of a surface of the stationary structure, a surface of-said movable segment, and an intermediate surface placed upon one of said stationary structure surface and said movable segment surface.

6. The cord lock and release system of claim 1 wherein said locking member is a generally cylindrical pin.

7. The cord lock and release system of claim 6 wherein said stationary structure has two opposed walls, each wall having a respective opposed slot extending towards and away from said holding surface defining said preselected path, and wherein said pin is disposed through said opposed slots.

8. The cord lock and release system of claim 7 wherein said slots are generally arcuate.

9. The cord lock and release system of claim 7 wherein said movable segment moves linearly in a selected direction relative to said stationary structure.

10. The cord lock and release system of claim 9 wherein said movable segment has two opposed walls, said opposed walls having respective opposed notches extending substantially perpendicular to said direction of movement of said movable segment, said notches extending toward and away from said holding surface, and wherein said pin is disposed through said opposed notches, each opposed movable segment wall being positioned adjacent a respective wall of said stationary structure.

11. The cord lock and release system of claim 10 wherein said means for biasing said locking member into said locked position comprising contact of said locking member with said movable segment at said slots.

12. The cord lock and release system of claim 6 further comprising a pivotal connection connecting one end of said movable segment to said stationary structure so as to allow said movable segment to move arcuately relative to said stationary structure.

13. The cord lock and release system of claim 12 wherein said movable segment has a groove provided thereon at some distance from said pivotal connection, wherein said pin is provided within said groove.

14. The cord lock and release system of claim 13 wherein said means for biasing said locking member into said locked position comprising contact of said locking member with said movable segment at said groove.

15. The cord lock and release system of claim 6 wherein said pin has a textured surface.

16. The cord lock and release system of claim 2 wherein said locking member is a cam, and wherein a pivotal connection connects one end of said cam to said stationary member.

17. The cord lock and release system of claim 16 wherein said movable segment moves linearly in a selected direction relative to said stationary structure.

18. The cord lock and release system of claim 17 wherein said movable segment having at least one protruding portion, said at least one protruding portion extending generally perpendicular to said direction of movement of said movable segment and facing said cam.

19. The cord lock and release system of claim 18 wherein when said movable segment is moved into said first position said movable segment protruding portions contact said cam and move said cam along said preselected path into said open position.

20. The cord lock and release system of claim 18 wherein said means for biasing said locking member into said locking position comprising a spring connecting said cam to said stationary structure such that said spring biases said cam along said preselected path into said locked position.

21. The cord lock and release system of claim 17 further comprising a guide pin disposed through said cam at some distance from said pivotal connection.

22. The cord lock and release system of claim 21 wherein said movable segment has two opposed walls, said opposed walls having respective opposed notches extending toward and away from said holding surface, and wherein said pin is disposed through said opposed notches.

23. The cord lock and release system of claim 22 wherein said means for biasing said locking member into said locking position comprising contact of said locking member with said movable member at said slots.

24. The cord lock and release system of claim 22 wherein said notches are generally arcuate.

25. The cord lock and release system of claim 1 wherein said means for biasing said movable segment into said second position comprising at least one spring connecting said movable segment to said stationary structure.

26. The cord lock and release system of claim 1 wherein said means of biasing said movable segment into said second position comprising at least one spring connecting said locking member to said stationary structure, wherein said spring biases said locking member into a locked position and said locking member contacts said movable segment thereby moving said movable segment into said second position.

27. The cord lock and release system of claim 1 further comprising a means for varying the ratio of length of release cord pulled by the operator to distance movable segment travels, said means comprising a post disposed upon said movable segment, wherein one end of said release cord is looped around said post and is affixed to said stationary member.

28. The cord lock and release system of claim 2 wherein said holding surface is one of a surface of the stationary structure, a surface of said movable segment, and an intermediate surface placed upon one of said stationary structure surface-and said movable segment surface.

29. The cord lock and release system of claim 2 wherein said locking member is a generally cylindrical pin.

30. The cord lock and release system of claim 29 wherein said stationary structure has two opposed walls, each wall having a respective opposed slot extending towards and away from said holding surface defining said preselected path, and wherein said pin is disposed through said opposed slots.

31. The cord lock and release system of claim 30 wherein said slots are generally arcuate.

32. The cord lock and release system of claim 30 wherein said movable segment moves linearly in a selected direction relative to said stationary structure.

33. The cord lock and release system of claim 32 wherein said movable segment has two opposed walls, said opposed walls having respective opposed notches extending substantially perpendicular to said direction of movement of said movable segment, said notches extending toward and away from said holding surface, and wherein said pin is disposed through said opposed notches, each opposed movable segment wall being positioned adjacent a respective wall of said stationary structure.

34. The cord lock and release system of claim 33 wherein said means for biasing said locking member into said locked position comprising contact of said locking member with said movable segment at said slots.

35. The cord lock and release system of claim 29 further comprising a pivotal connection connecting one end of said movable segment to said stationary structure so as to allow said movable segment to move arcuately relative to said stationary structure.

36. The cord lock and release system of claim 35 wherein said movable segment has a groove provided thereon at some distance from said pivotal connection, wherein said pin is provided within said groove.

37. The cord lock and release system of claim 36 wherein said means for biasing said locking member into said locked position comprising contact of said locking member with said movable segment at said groove.

38. The cord lock and release system of claim 29 wherein said pin has a textured surface.

39. The cord lock and release system of claim 32 wherein said locking member is a cam, and wherein a pivotal connection connects one end of said cam to said stationary member.

40. The cord lock and release system of claim 39 wherein said movable segment moves linearly in a selected direction relative to said stationary structure.

41. The cord lock and release system of claim 40 wherein said movable segment having at least one protruding portion, said at least one protruding portion extending generally perpendicular to said direction of movement of said movable segment and facing said cam.

42. The cord lock and release system of claim 41 wherein when said movable segment is moved into said first position said movable segment protruding portions contact said cam and move said cam along said preselected path into said open position.

43. The cord lock and release system of claim 41 wherein said means for biasing said locking member into said locking position comprising a spring connecting said cam to said stationary structure such that said spring biases said cam along said preselected path into said locked position.

44. The cord lock and release system of claim 40 further comprising a guide pin disposed through said cam at some distance from said pivotal connection.

45. The cord lock and release system of claim 44 wherein said movable segment has two opposed walls, said opposed walls having respective opposed notches extending toward and away from said holding surface, and wherein said pin is disposed through said opposed notches.

46. The cord lock and release system of claim 45 wherein said means for biasing said locking member into said locking position comprising contact of said locking members with said movable member at said slots.

47. The cord lock and release system of claim 45 wherein said notches are generally arcuate.

48. The cord lock and release system of claim 2 wherein said means for biasing said movable segment into said second position comprising at least one spring connecting said movable segment to said stationary structure.

49. The cord lock and release system of claim 2 wherein said means of biasing said movable segment into said second position comprising at least one spring connecting said locking member to said stationary structure, wherein said spring biases said locking member into a locked position and said locking member contacts said movable segment thereby moving said movable segment into said second position.

50. The cord lock and release system of claim 2 further comprising a means for varying the ratio of length of release cord pulled by the operator to distance movable segment travels, said means comprising a post disposed upon said movable segment, wherein one end of said release cord is looped around said post and is affixed to said stationary member.

51.The cord lock and release system of claim 2 wherein said stationary structure is a housing affixed to said headrail.

52. The cord lock and release system of claim 51 wherein said housing is affixed to a bracket which is mounted on said headrail.

* * * * *